United States Patent [19]

Abthoff et al.

[11] 4,428,347

[45] Jan. 31, 1984

[54] INTERNAL COMBUSTION ENGINE

[75] Inventors: Jörg Abthoff, Flüderhausen; Hans-Dieter Schuster, Schorndorf; Hans-Joachim Langer, Remseck; Christoph Noller, Waiblingen, all of Fed. Rep. of Germany

[73] Assignee: Daimler-Benz Aktiengesellschaft, Fed. Rep. of Germany

[21] Appl. No.: 236,508

[22] Filed: Feb. 20, 1981

[30] Foreign Application Priority Data

Feb. 20, 1980 [DE] Fed. Rep. of Germany ..... 3006369

[51] Int. Cl.[3] ..... F02M 39/00

[52] U.S. Cl. ..... 123/453; 123/459; 123/462

[58] Field of Search ..... 123/453, 459, 462, 452, 123/454, 455

[56] References Cited

U.S. PATENT DOCUMENTS

| | | | |
|---|---|---|---|
| 3,942,496 | 3/1976 | Gisele et al. | 123/459 |
| 3,981,288 | 9/1976 | Wessel | 123/482 |
| 3,993,032 | 11/1976 | Passera | 123/453 |
| 3,993,034 | 11/1976 | Passera | 123/453 |
| 4,167,169 | 9/1979 | White | 123/459 |
| 4,266,520 | 5/1981 | Muller | 123/453 |
| 4,284,048 | 8/1981 | Schelhas | 123/453 |

*Primary Examiner*—Ira S. Lazarus
*Assistant Examiner*—Magdalen Moy
*Attorney, Agent, or Firm*—Craig & Burns

[57] ABSTRACT

A fuel-injected internal combustion engine wherein fuel is injected in dependence upon a quantity or volume of air supplied to the engine. A throttle valve controls the airflow rate with an $O_2$ probe, arranged in an exhaust manifold, controlling a timing valve through a control device for enabling a timed relief of injection pressure of the fuel. An ignition starter switch is connected to the control device in such a manner that the timing valve is fully open during an operation of the ignition starter switch so as to enable a starting boost. An adjustable timing member is coupled to an operating switch provided in the control device, which operating switch closes automatically after a termination of the starting process. The timing member maintains the timing valve in a fully open position during a specific time span so as to provide for an after-start boost. An additional timing member is adapted to maintain the timing valve in a fully open position during a short time span so as to enable an acceleration enrichment. The control device renders the start boost, after-start boost, and acceleration enrichment ineffective upon the probe reaching its normal operating temperature.

4 Claims, 1 Drawing Figure

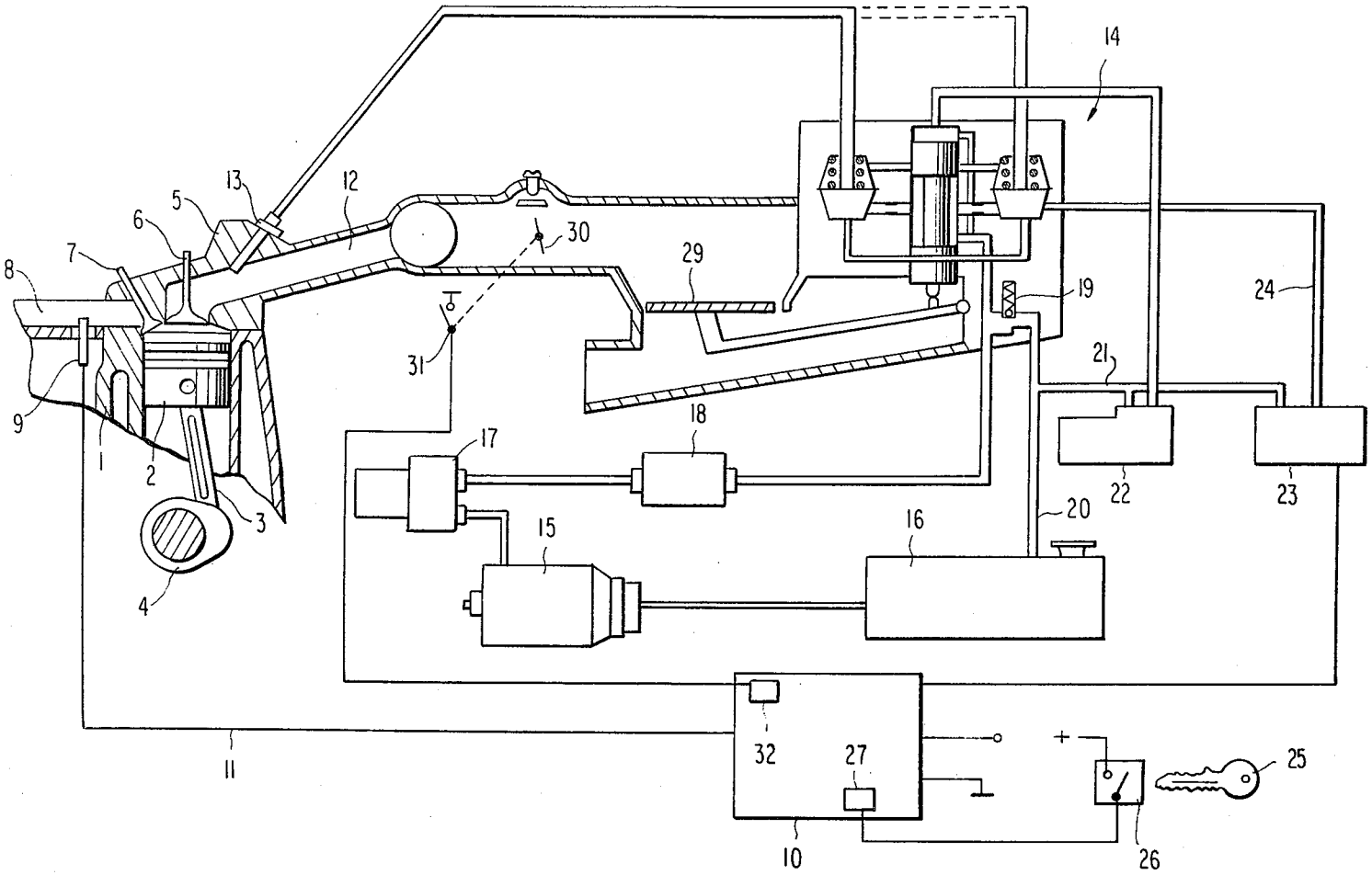
1
2
3
4
5
6
7
8
9
10
11
12
13
14
15
16
17
18
19
20
21
22
23
24
25
26
27
29
30
31
32
+
-

INTERNAL COMBUSTION ENGINE

The present invention relates to an internal combustion engine and, more particularly, to a fuel-injected internal combustion engine wherein the fuel is injected in dependence upon the air quantity or volume, with a throttle valve means being provided for controlling the rate of airflow as well as an $O_2$ probe arranged in the exhaust manifold, which probe, through a control device, controls a timing valve in order to provide for a timed relief of injection pressure at the injection valves and an ignition starter switch and operating switch which closes automatically after a termination of a starting process of the engine.

In internal combustion engines which include a three-way catalyst unit (TWC), up to 80% CO and HC proportions are formed in the exhaust gas during a warming-up operation of the engine. These contaminants are formed during the warm-up phase of the engine since the catalyst has not yet reached its full operating temperature at which optimum conversion rate takes place so as to render the exhaust gases non-poisonous. Additionally, since the internal combustion engine has not yet warmed up for operation, the engine exhibits higher friction losses and also a poor mixture preparation. For this reason, a greater amount of fuel must be fed relative to the amount of drawn-in air during the time span representing the warm-up phase of the engine so that the engine operates with a fuel enrichment.

In U.S. Pat. No. 3,981,288, an arrangement is proposed for constructing a characteristic curve for a warming-up regulator for fuel-injected internal combustion engines in order to determine the enrichment in dependence upon the quantity of air supplied. The fuel enrichment process in this proposed construction is reduced in dependence upon a duration of a heating-up time of a bimetallic spring element.

It has also been proposed to correct a pilot control of the air-volume-dependent injection in internal combustion engines during a warm-up phase by a timing valve which is regulated or controlled by an $O_2$ probe with a control operation providing for a $\lambda=1$ when the $O_2$ probe is warmed up for operation. However, a disadvantage of this proposed arrangement resides in the fact that when the $O_2$ probe is not warmed up, a constant timing ratio is regulated at the timing valve and, in such situations, high CO and HC proportions are present in the exhaust gas of the engine.

The aim underlying the present invention essentially resides in providing an arrangement for controlling the air/fuel ratio to an internal combustion engine during a warm-up phase operation so as to substantially reduce the emission of deleterious materials or pollutants during a warm-up phase of the engine.

In accordance with advantageous features of the present invention, an ignition starter switch 25 is connected to a control device in such a manner that a timing valve is fully open during an operation of the ignition starter switch so as to provide for a starting boost with an adjustable timing member being coupled to the operating switch provided in the control device. The timing member maintains the timing valve in a fully open position during a specific time span so as to provide for an after-start boost.

By virtue of the above-noted features of the present invention, it is possible, at a low cost, to choose a basic level for a fuel/air ratio of the internal combustion engine to be leaner during a warm-up operation of the engine.

With an internal combustion engine provided with an idler contact coupled to a throttle or butterfly valve and closed when the throttle valve is closed, it is possible in accordance with the present invention, to provide a further timing member in the control device, which member, after an opening of the idler contact, maintains the timing valve in a fully open position during a short time span so as to provide for an acceleration enrichment.

By virtue of the present invention, a smaller amount of poisonous pollutants or deleterious materials are formed during the critical points in the driving operation of the engine such as a start boost, the after-start boost, and also during acceleration from the idling or coasting operation.

According to the present invention, the air/fuel ratio during the warm-up operation of the engine is regulated by $O_2$ probes with an air-volume-dependent injection. The $O_2$ probe may be connected with the control device in such a manner and the control device may be constructed in such a fashion that when the $O_2$ probe has reached its operating temperatures, the functions, i.e. start boost, after-start boost, and acceleration enrichment, are rendered ineffective, with the metered fuel feed to the internal combustion engine then being controlled exclusively by the $O_2$ probe.

Advantageously, in accordance with the present invention, the after-start boost may amount to about 15 to 20 seconds and the acceleration enrichment may last between 1.5 and 2 seconds.

By virtue of the present invention, it may readily be adapted to all internal combustion engines provided with an $O_2$ probe control.

Accordingly, it is an object of the present invention to provide an internal combustion engine for a motor vehicle which avoids, by simple means, shortcomings and disadvantages encountered in the prior art.

A further object of the present invention resides in providing a fuel-injected internal combustion engine which enables the improvement of intervention possibilities for controlling the air/fuel ratio during a warm-up operation in internal combustion engines regulated by $O_2$ probes.

Yet another object of the present invention resides in providing an internal combustion engine which minimizes the emission of deleterious materials or pollutants in the exhaust gases during a warm-up operation of the engine.

A still further object of the present invention resides in providing an internal combustion engine wherein the basic level of the fuel/air ratio can be set to be leaner during a warm-up operation of the engine.

Yet another object of the present invention resides in providing an internal combustion engine which functions reliably under all operating conditions.

These and other objects, features, and advantages of the present invention will become more apparent from the following description when taken in connection with the accompanying drawing which shows, for the purposes of illustration only, one embodiment in accordance with the present invention, and wherein:

The single FIGURE of the drawing is a partially schematic cross-sectional view of an internal combustion engine constructed in accordance with the present invention.

Referring now to the single FIGURE of the drawing, according to this FIGURE, a multi-cylinder fuel-injected internal combustion engine includes a cylinder block 1 with a piston 2 being disposed in respective cylinders in the cylinder block. The piston 2 is connected to a crankshaft 4 by means of a connecting rod 3. At least one inlet valve 6 and one outlet valve 7 is provided in the cylinder head for the respective cylinders. An $O_2$ probe or sensor 9 is disposed in an exhaust manifold 8. The probe or sensor 9 is connected to a control device 10 of a conventional construction, by way of an electrical line 11.

A fuel-injection unit 13 is disposed in the intake manifold 12. Injection unit 13 injects fuel in dependence upon an amount of air supplied to the intake manifold 12. The injection unit 13 supplies the internal combustion engine with a quantity of fuel corresponding to operating conditions by way of a volume distributor generally designated by the reference numeral 14, which distributor 14 is controllable in dependence upon the amount or volume of air taken in.

Fuel is conveyed to the fuel injection unit 13 by way of a fuel pump 15 from a fuel tank 16 to a reservoir 17 and, through a fuel filter 18, to the volume distributor 14. Excess fuel conveyed may return to the fuel tank 16 through a conduit 20 by way of a pressure relief valve 19 provided in the volume distributor 14. A branch line 21 extends from the conduit 20 to a warm-up controller 22 and to a timing valve 23 which is adapted to be operated by the control device 10. The timing valve 23 is connected through a conduit 24 to the volume distributor 14.

If the $O_2$ probe is not warmed up for operation, a constant timing ratio transmitted by the control device 10 to the timing valve 23 is altered to the effect that, upon operation of an ignition starter key 25, the timing valve 23 is fully open so as to provide for a start boost.

After the startup of the internal combustion engine, upon the closing of an operating switch 26, the timing valve 23 is maintained in the fully open position for a predetermined duration of time of, for example, 15–20 seconds by way of a first timing member 27 arranged in the control device so as to provide for an after-start boost.

The $O_2$ probe is ready for operation at a temperature of about 320°–350° C. and, upon reaching such temperature, the probe takes over the further regulation of the air/fuel ratio to a $\lambda=1$ and cuts off the operation of the control device for the start boost, after-start boost, and acceleration enrichment.

A throttle valve 30 is provided in the intake manifold 29 and is connected to an idler contact 31 in such a way that, with the throttle valve 30 being closed, the idler contact 31 is likewise closed and, when the throttle valve 30 is opened, the idler contact 31 is likewise opened. The idler contact 31 is connected to a second timing member 32 arranged in the control device 10, with the second timing member also serving for setting of a time period. During an opening of the idler contact 31, the timing valve 23 is also fully opened through the timing member 32 so that the air/fuel mixture is enriched over a predetermined set period of time such as, for example, about 1.5 to 2 seconds thereby enabling an acceleration enrichment.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are ecompassed by the scope of the appended claims.

We claim:

1. An internal combustion engine comprising a throttle valve means for controlling a rate of flow of air supplied to the engine, means for injecting fuel in dependence upon a volume of air supplied to the engine, a timing valve means for providing a time relief of injection pressure of the fuel injection means, means for controlling the timing valve means, an ignition starter means for starting the engine, and an operating switch means adapted to automatically close after a termination of a starting operation of the engine, characterized in that means are provided for connecting the ignition starter means with the timing valve means for fully opening the timing valve means during an operation of the ignition starter means for a starting operation of the engine, and in that the controlling means includes an adjustable timing means coupled to the operating switch means for maintaining the timing valve means in the fully open position for a predetermined time span following a starting-up of the engine for enabling an after-start operation, in that the controlling means further includes an exhaust gas sensor means disposed in an exhaust system of the engine, and a control device disposed between the sensor means and the timing valve means, in that an idler contact means is coupled with the throttle valve means and is adapted to be closed during a closing of the throttle valve means, and in that the controlling means further includes an additional timing means arranged in the control device for maintaining the timing valve means in a fully open position for a predetermined time period after an opening of the idler contact means so as to enable an acceleration enrichment of the fuel supplied to the engine.

2. An internal combustion engine according to claim 1, characterized in that the control device further includes means for rendering the timing valve means ineffective upon the sensor means reaching a predetermined operating temperature.

3. An internal combustion engine according to one of claims 1 or 2, characterized in that the predetermined time span is 15–20 seconds.

4. An internal combustion engine according to claim 3, characterized in that the predetermined time period is 1.5–2 seconds.

* * * * *